US006036063A

United States Patent [19]

Rhyne

[11] Patent Number: 6,036,063

[45] Date of Patent: Mar. 14, 2000

[54] ALPHABET HANGER

[75] Inventor: Steven B. Rhyne, Lookout Mtn., Tenn.

[73] Assignee: Rhyne Packaging Company, Chattanoogo, Tenn.

[21] Appl. No.: 09/212,097

[22] Filed: Dec. 15, 1998

Related U.S. Application Data

[63] Continuation-in-part of application No. 29/088,550, May 27, 1998, Pat. No. Des. 411,052.

[51] Int. Cl.[7] ..... A47G 25/14

[52] U.S. Cl. ..... 223/85; 223/DIG. 4; 40/322

[58] Field of Search ..... D6/315; 223/85, 223/DIG. 4, 92; 40/322

[56] References Cited

U.S. PATENT DOCUMENTS 4,322,902 4/1982 Lenthall ..... 40/322

4,624,396 11/1986 Universe ..... 223/92

4,863,078 9/1989 Bengsch ..... 223/85

*Primary Examiner*—Bibhu Mohanty

*Attorney, Agent, or Firm*—Alan Ruderman; Miller & Martin LLP

[57] ABSTRACT

A hanger having a product or package supporting member and a carrier or suspension member for suspending the hanger from a peg or the like, the carrier or suspension member having a decorative portion including a structure forming a letter of an alphabet. The letter of the alphabet is a Roman-style letter. A hanger of this type may thus be used by a retailer or a manufacturer of product, such as socks and hosiery to emphasize the association of the goods or the package with the retailer when the product is merchandised.

18 Claims, 2 Drawing Sheets

ALPHABET HANGER

REFERENCE TO RELATED APPLICATIONS

This application is a continuation in part of U.S. application Ser. No. 29/088,550 filed May 27, 1998 now D411, 052.

BACKGROUND OF THE INVENTION

This invention relates to a hanger for hanging products or packages from a peg or the like, and more particularly to a package hanger having a decorative supporting carrier in the form of a letter of the alphabet.

Hangers for displaying various articles of clothing such as socks on pins or pegs of a point of purchase display panel in the prior art have been devoid of decoration except for those package hangers comprising cardboard folded into a package. In those packages, such as that shown in U.S. Pat. Nos. 4,257,522 and 5,469,959, decorative material may be imprinted on the package panels. Here the packages have perforation through which the pin or peg may enter to support the package. In other packages such as in U.S. Pat. No. 4,347,930, the package may have printed material, but also hang by a hook. Other hooks in the prior art do not appear to have been patented except for that of the applicant herein illustrated in U.S. Design Pat. No. 283,273. Such hooks generally include a hook portion of a shape similar to a clothes hanger and may have a support portion below the hook portion which is straight as in the cited U.S. Pat. No. 4,347,930 or the cited U.S. Design Pat. No. 283,273. Others such as those which support a plastic bag within which socks may be merchandised may have a product carrier or support portion of elongated rod shape, some of which may have the end of the rod bent to face the hook. But in any event, none of the known prior art hangers have decorative hooks or hanger carrier portions.

SUMMARY OF THE INVENTION

Consequently, it is a primary object of the present invention to provide a hanger having a product carrier portion and a decorative suspension portion for being suspended from or carrier on a pin, peg or finger extending from a product display panel.

It is another object of the present invention to provide a hanger having a product carrier portion and a decorative suspension portion, the decorative suspension portion, which in the prior art is denoted as the hook, being a letter of the alphabet.

It is a further object of the present invention that a hanger having a package supporting arm and an integral decorative hanger support or suspender above the arm, the suspender having structure defining a Roman style alphabet letter.

Accordingly, the present invention comprises a hanger having a product or package supporting member and a suspension member having a decorative portion including structure forming a letter of an alphabet, the decorative portion having a surface which may be carried by a peg, pin or finger extending substantially horizontally from a display panel. The letter of the alphabet is a Roman style letter as used with English language names. Thus, a hanger may be used by a retailer to emphasize the association of the goods or the packaged goods with the retailer. For example, a retailer or marketer of goods having a name which commences with one letter may use a hanger having that letter as a decorative portion suspending the hanger from a finger.

The letter of the alphabet may have wall structure which defines an enclosed opening so that the structure may encircle the pin, peg or finger, or the wall structure may define a discontinuity which opens onto the pin, peg or finger engaging portion to receive the pin, peg or finger in lateral fashion.

BRIEF DESCRIPTION OF THE DRAWINGS

The particular features and advantages of the invention as well as other objects will become apparent from the following description taken in connection with the accompanying drawings in which:

FIG. 3 illustrates a plurality of hangers of the present invention wherein the decorative hanger carrier has an enclosed opening for mounting on a peg, finger or the like;

DESCRIPTION OF THE PREFERRED EMBODIMENT

Figure 5:
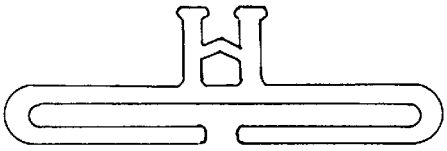
FIG. 5 illustrates another type hanger such as that used to hang tights.
Figure 6:
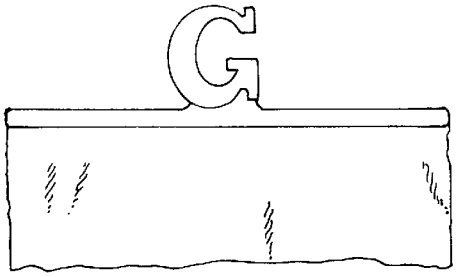
FIG. 6 illustrates a hanger used within a bag.

Referring now to the drawings, a hanger 10 of the prior art has a hanger support carrier in the form of a hook 12 similar to a clothes hanger and a product support arm 14. The central open section of a hook 12 in use is positioned on and carried by a peg or pin, hereinafter denoted a "finger" 16 either mounted on a display panel 18 or being a length of rack (not illustrated) on which a plurality of such hangers are carried. The product support arm 14, which preferably is integral with and molded from plastic together with the hook, is disposed below the hook and in substantially the same vertical plane. The support arm 14 may carry the product, such as a pair of socks or hosiery, directly thereon or may carry a package such as a bag within which the product is disposed. If the hanger carries the product directly, a tail 20 may be formed on the end of the arm to prevent the product from being pulled off. For other products such as tights or the like, the support arm may include a pair of hooks 21 facing each other as illustrated in FIG. 5, but if the product is carried within a bag or the like, the tail may be dispensed with as illustrated in FIG. 6. Thus, the product, such as a pair of socks, may be folded about the arm 14 beneath the hook or the arm may pass through the package in which the socks are disposed.

Figure 1:
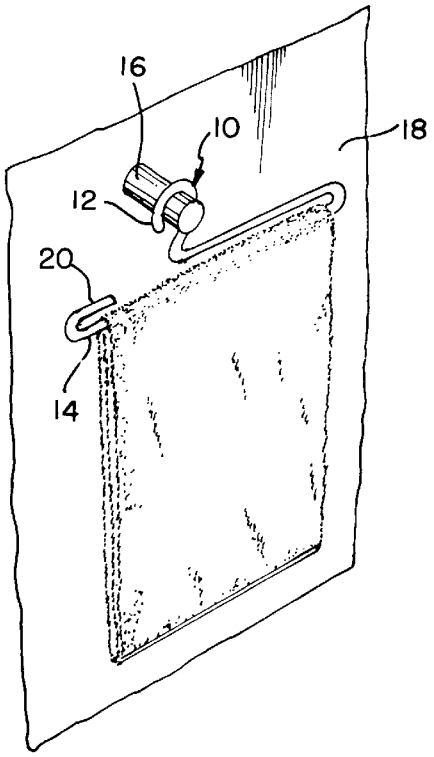
FIG. 1 PRIOR ART
FIG. 1 illustrates a hanger in the prior art having an article to be displayed carried thereon.
Figure 2:
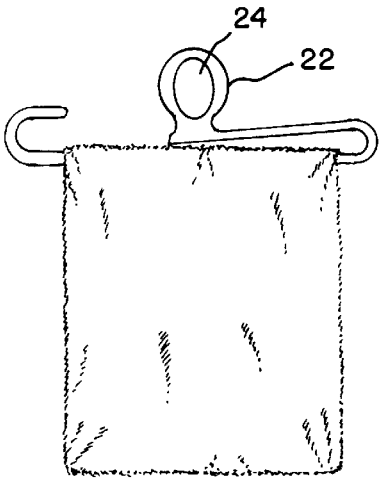
FIG. 2 illustrates a hanger constructed in accordance with the present invention carrying an article to be displayed.
Figure 4:
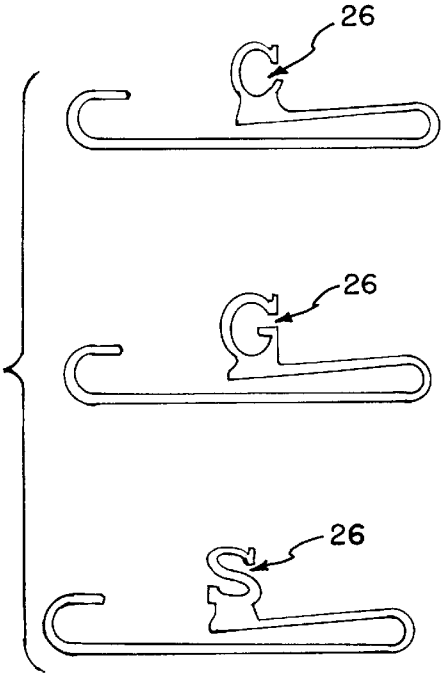
FIG. 4 illustrates another plurality of hangers having the decorative finger carrier having a peg or finger receiving mounting portion which opens laterally.
Figure 3:
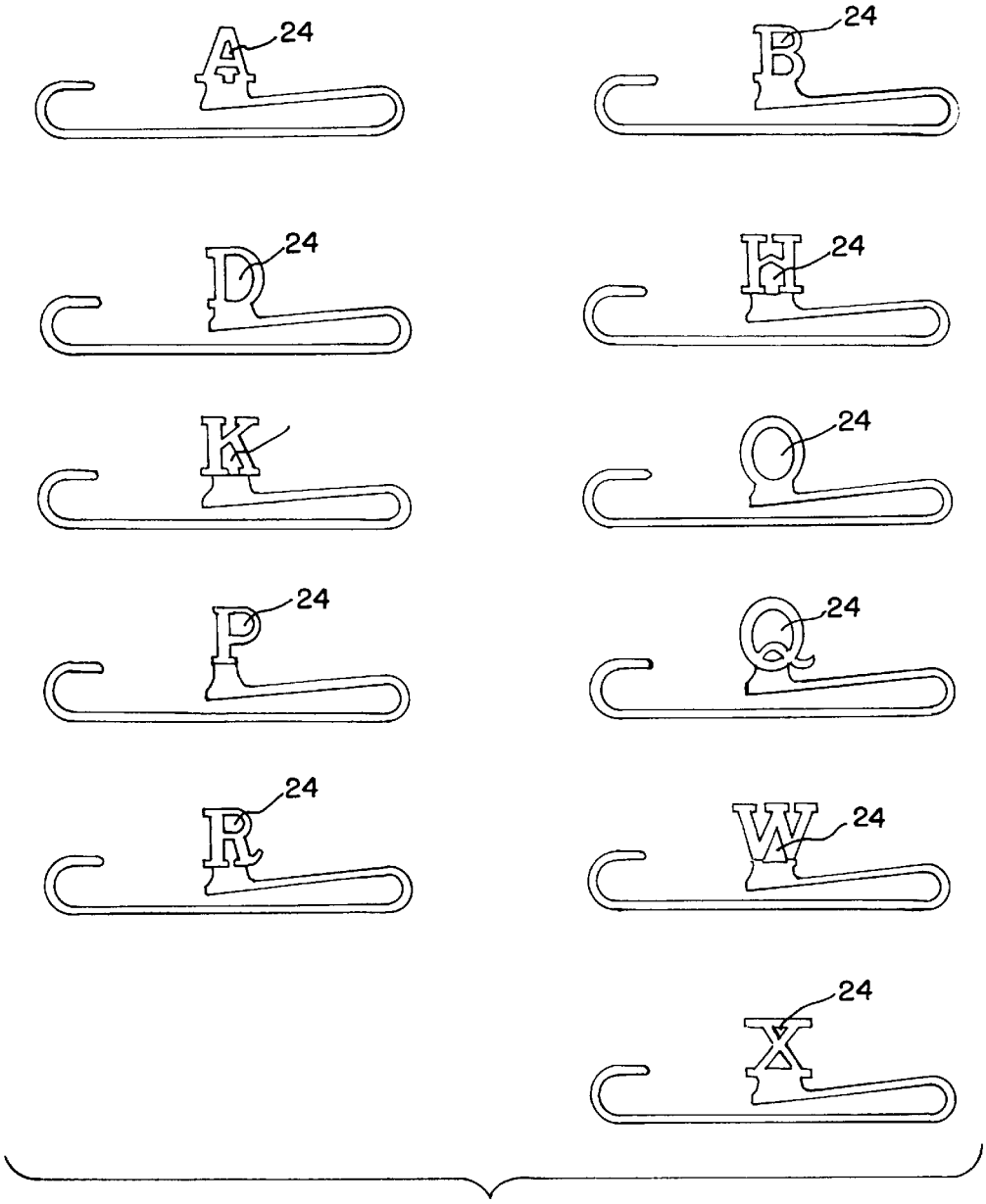

In accordance with the present invention the hook 12 of the prior art is replaced by a decorative element 22 in the form of a letter of the alphabet. The letter preferably being of a Roman style which is used for writing and spelling in the English language. As illustrated in FIG. 2, with regard to the letter "O" the hanger, except for the hanger carrier, being a letter of the alphabet, the hanger is substantially the same as in the prior art. Thus, the support arm 14 is substantially coplanar with the decorative carrier disposed beneath it. A manufacturer or retailer of products such as socks may, therefore, stylize its hangers with the first letter of its name or trademark. Consequently, the letter may be any of the letters which will permit the decorative hanger carrier member, i.e., the portion of the hanger that acts to suspend the hanger from the finger 14 of the display or rack to be suspended from the finger. The letter illustrated in FIGS. 3 and 4 are examples of such letters. Certain of those letters, e.g. those illustrated in FIG. 3, have elements which may be fully closed about the finger 16 when mounted thereon. At least these letters are A, B, D, H, K, O, P, Q, R, W and X. For example, the finger 16 may enter the respective openings 24 in any of these letters and carry the hanger. In others of the letters, e.g. those illustrated in FIG. 4, to wit, the letters C, G and S, the carrier may receive the finger 16 by laterally moving over the finger, i.e., permitting the finger to enter the lateral opening 26 in the letter.

It is therefore clear that the hanger carrier portion may be a decorative letter of the alphabet. Thus, a company named Don's Hosiery may select a hanger with the letter D as the hanger carrier.

Although not all the letters are shown, the other letters of the Roman alphabet may be selected by changing the form of the letters. For example, Jones Hosiery may use a script J. Other examples are readily apparent so that substantially any letter of the alphabet may be used.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hanger comprising a product supporting member, a carrier member integral with the product supporting member having a decorative portion disposed above said product supporting member, said decorative portion comprising structure defining a single letter of an alphabet, and wherein at least one surface of said letter of an alphabet of the decorative portion may be supported by and cooperate with a portion of a support finger so that said hanger may be carried by said support finger.

2. A hanger as recited in claim 1, wherein the letter of the alphabet is a Roman-type letter.

3. A hanger as recited in claim 1, wherein said at least one surface of said decorative portion may cooperate with said portion of said support finger by resting atop said portion of said support finger.

4. A hanger as recited in claim 1, wherein at least of portion of said product supporting member is below a portion of said decorative portion.

5. A hanger as recited in claim 1, wherein said supporting member lies in a substantially common plain with the decorative portion.

6. A hanger as recited in claim 5, wherein said supporting member is integral with said decorative portion.

7. A hanger as recited in claim 2, wherein the letter of the alphabet is selected from the group consisting of A, B, C, D, G, H, K, O, P, Q, R, S, W, and X.

8. A hanger for supporting a package on a substantially horizontally disposed finger extending substantially horizontally from a substantially vertically disposed display surface, each hanger having a product supporting arm and an integral decorative hanger carrier disposed above and in substantially the same plane as the arm, said carrier having a Roman-style single alphabetic letter configuration, said Roman-style alphabetic letter configuration having a finger-engaging portion permitting the receipt and capture of a finger above said arm transverse to the plane of said carrier so that said carrier may engage and hang from said finger with the plane of said carrier substantially parallel to said vertically disposed surface.

9. A hanger as recited in claim 8, wherein said carrier has wall structure which defines an enclosed opening so that the structure is fully closed about said finger-engaging portion.

10. A hanger as recited in claim 9, wherein said carrier has the configuration of a letter selected from the group consisting of A, B, D, H, K, O, P, Q, R, W, and X.

11. A hanger as recited in claim 8, wherein said carrier has wall structure which opens onto said finger-engaging portion.

12. A hanger as recited in claim 11, wherein said carrier has a configuration of letters selected from the group consisting of C, G, and S.

13. A hanger comprising: a product supporting member, a carrier member having a decorative portion unitary with and disposed above said product supporting member, said decorative portion comprising means defining a single letter of an alphabet with at least one surface of said letter cooperating with a portion of a support finger permitting said finger to carry said hanger.

14. A hanger as recited in claim 13, wherein the letter of the alphabet is a Roman-type letter.

15. A hanger as recited in claim 13, wherein a surface of said decorative portion cooperates with said support by resting atop said portion of said support.

16. A hanger as recited in claim 13, wherein said supporting member lies in a substantially common plane with said decorative portion.

17. A hanger as recited in claim 16, wherein said supporting member is integral with the decorative portion.

18. A hanger as recited in claim 14, wherein the letter of the alphabet is selected from the group consisting of A, B, C, D, G, H, K, O, P, Q, R, S, W and X.

* * * * *